US008425352B1

(12) United States Patent
Loduca et al.

(10) Patent No.: US 8,425,352 B1
(45) Date of Patent: Apr. 23, 2013

(54) MECHANICAL BASEBALL TEE

(75) Inventors: Salvatore Loduca, Great Neck, NY (US); Michael Richard Laluna, Merrick, NY (US)

(73) Assignee: Robosport Technologies LLC, Great Neck, NY (US)

( * ) Notice: Subject to any disclaimer, the term of this patent is extended or adjusted under 35 U.S.C. 154(b) by 25 days.

(21) Appl. No.: 13/248,122

(22) Filed: Sep. 29, 2011

(51) Int. Cl.
*A63B 69/00* (2006.01)

(52) U.S. Cl.
USPC ..... 473/418; 473/451

(58) Field of Classification Search ..... 473/417–419, 473/422, 426, 427, 429, 430, 451
See application file for complete search history.

(56) References Cited

U.S. PATENT DOCUMENTS

| | | | | | |
|---|---|---|---|---|---|
| 3,006,647 | A | * | 10/1961 | Haskett | 473/429 |
| 3,318,068 | A | * | 5/1967 | Voullaire | 53/537 |
| 3,529,823 | A | * | 9/1970 | Garver | 473/418 |
| 3,940,132 | A | | 2/1976 | Lopatto, III | |
| 4,161,313 | A | * | 7/1979 | Dickey | 473/449 |
| 4,352,494 | A | * | 10/1982 | Wells | 473/449 |
| 4,456,250 | A | | 6/1984 | Perrone, Jr. | |
| 5,160,131 | A | | 11/1992 | Leon | |
| 5,228,683 | A | | 7/1993 | Beimel | |
| 5,590,876 | A | | 1/1997 | Sejnowski | |
| 5,647,338 | A | | 7/1997 | Martin | |
| 5,882,270 | A | | 3/1999 | Daugherty | |
| 6,146,289 | A | * | 11/2000 | Miller et al. | 473/417 |
| 6,167,878 | B1 | | 1/2001 | Nickerson et al. | |
| 6,296,582 | B1 | | 10/2001 | Minniear | |
| 6,413,175 | B1 | * | 7/2002 | Mooney, Jr. | 473/417 |
| 6,443,859 | B1 | | 9/2002 | Markin | |
| 6,551,204 | B1 | * | 4/2003 | Di Re | 473/417 |
| 7,828,679 | B2 | | 11/2010 | Tell et al. | |
| D633,583 | S | | 3/2011 | Guevara | |
| 2001/0003106 | A1 | * | 6/2001 | Brenneisen | 473/430 |
| 2003/0064836 | A1 | * | 4/2003 | Moss et al. | 473/417 |
| 2005/0130770 | A1 | | 6/2005 | Battisto | |
| 2009/0082140 | A1 | * | 3/2009 | Liao | 473/417 |
| 2012/0202621 | A1 | * | 8/2012 | Belt | 473/417 |

* cited by examiner

*Primary Examiner* — Mark Graham
(74) *Attorney, Agent, or Firm* — Akerman Senterfitt; Mark D. Passler

(57) ABSTRACT

A hitting training aid is provided, such as a mechanical tee for batting practice. The mechanical tee may present a ball to a batter at various heights, positions, speeds, and angles to simulate real game conditions. The mechanical tee may include a vertical stand with a variable position, retractable post that supports flexible tubing with a suction cup at the end to hold a ball in a suspended manner for striking. The mechanical tee may have a motor and vacuum pump configuration to provide suction, and may automatically feed balls to a batter. The vertical stand may additionally have an air compressor and an attachment for pneumatically tossing or propelling a ball upward for striking. The mechanical tee may move, or toss, a ball to variable and/or random placements within a three dimensional strike zone. A portable stand may have several telescopic pistons for lifting a ball at various placements.

20 Claims, 4 Drawing Sheets

MECHANICAL BASEBALL TEE

FIELD OF THE INVENTION

The present application relates to hitting and balling teaching aids. In particular, the present application relates to devices that improve a player's coordination and skill.

BACKGROUND

Conventional hitting aids may suspend a ball vertically, such as those disclosed by U.S. Pat. No. 5,228,683 to Beimel; U.S. Pat. No. 3,940,132 to Lopatto; U.S. Pat. No. 6,296,582 to Minniear; U.S. Pat. No. 5,882,270 to Daugherty; and U.S. Pat. No. 7,828,679 to Tell et al. A number of conventional devices may employ pneumatic methods of lifting a ball, such as those disclosed by U.S. Pat. No. 5,160,131 to Leon; U.S. Pat. No. 6,167,878 to Nickerson et al.; and U.S. Pat. No. 5,590,876 to Sejnowski.

However, in general, conventional hitting aids may suffer from various deficiencies. For instance, some conventional hitting aids may hold a ball at a stationary position. Other conventional hitting aids may hold or deliver a ball to the same height. As a result, batters may be continuously hitting balls, such as baseballs, at the same location. It is believed that this may hinder batter development. Another nuisance of conventional tees may be that they require manually replacing the ball after each swing. Conventional hitting aids may be structurally lacking or ineffective in other respects as well.

SUMMARY

The present embodiments relate to a hitting training aid, including a mechanical tee for batting practice. The mechanical tee may present a ball to the batter at various heights, positions, speeds, and/or angles to simulate real game conditions. The mechanical tee may be used with baseballs, tennis balls, softballs, plastic baseballs, Wiffle® balls, training balls, rubber balls, and/or other types of balls. The mechanical tee may include a vertical stand with a variable position, retractable post that supports flexible tubing. The vertical stand of the mechanical tee may enclose a motor and vacuum pump configuration that provides suction to the flexible tubing. The flexible tubing may have a suction cup at one end to hold a ball vertically and in a suspended manner for striking. The mechanical tee may also automatically feed the balls to a batter. Additionally or alternatively, the vertical stand may have an air compressor and an attachment for pneumatically tossing or propelling a ball upward for striking. The mechanical tee may suspend and/or toss a ball at variable and random placements. In another embodiment, the mechanical tee may be a portable stand having several telescopic pistons for lifting individual balls to differing and random heights.

In one aspect, a ball hitting training device may be provided. The ball hitting training device may include a vertical stand; a variable position, retractable post configured to extend upward from the vertical stand; and an electronic controller enclosed within the vertical stand. The electronic controller may be configured to move the retractable post (1) side-to-side horizontally, (2) side-to-side vertically, and/or (3) up and down with respect to the vertical stand. The ball hitting training device may include a vacuum pump enclosed within the vertical stand, with the vacuum pump configured to create a suction force. The ball hitting training device may include a suction line that is vertically and horizontally supported by the retractable post. The suction line may be attached to the vacuum pump at one end and have a suction cup at the other end such that during use the suction force created by the vacuum pump may vertically support a ball. The electronic controller may direct the retractable post that is supporting the suction line holding the ball vertically to move the ball through a three-dimensional strike zone. The ball may be moved through the three-dimensional strike zone at various heights, locations, speeds, and/or angles during use to mimic game situations and train the hand-eye movement of a batter to hit the ball at varying and random locations within the three-dimensional strike zone. The three-dimensional strike zone may be as defined by the Major League rule book.

In another aspect, a ball hitting training device may be provided. The ball hitting training device may include a vertical stand; a variable position, retractable post configured to extend upward from the vertical stand; and an electronic controller enclosed within the vertical stand. The electronic controller may be configured to move the retractable post (1) side-to-side horizontally, and (2) side-to-side vertically with respect to a three-dimensional strike zone. The ball hitting training device may include a vacuum pump enclosed within the vertical stand. The vacuum pump may be configured to create a suction force. The ball hitting training device may include a suction line that is vertically and horizontally supported by the retractable post. The suction line may be attached to the vacuum pump at one end and have a suction cup at the other end such that during use the suction force created by the vacuum pump may vertically support a ball. The electronic controller may direct the retractable post that is supporting the suction line holding the ball vertically to move the ball through the three-dimensional strike zone at various heights, locations, speeds, and/or angles during use to mimic game situations and train the hand-eye movement of a batter to hit the ball at varying and random locations within the three-dimensional strike zone.

The above-described and other features and advantages of the present disclosure will be appreciated and understood by those skilled in the art from the following detailed description, drawings, and appended claims.

BRIEF DESCRIPTION OF THE DRAWINGS

There is shown in the drawings embodiments which are presently preferred, it being understood, however, that the invention can be embodied in other forms without departing from the spirit or essential attributes thereof.

DETAILED DESCRIPTION OF THE INVENTION

Figure 1:
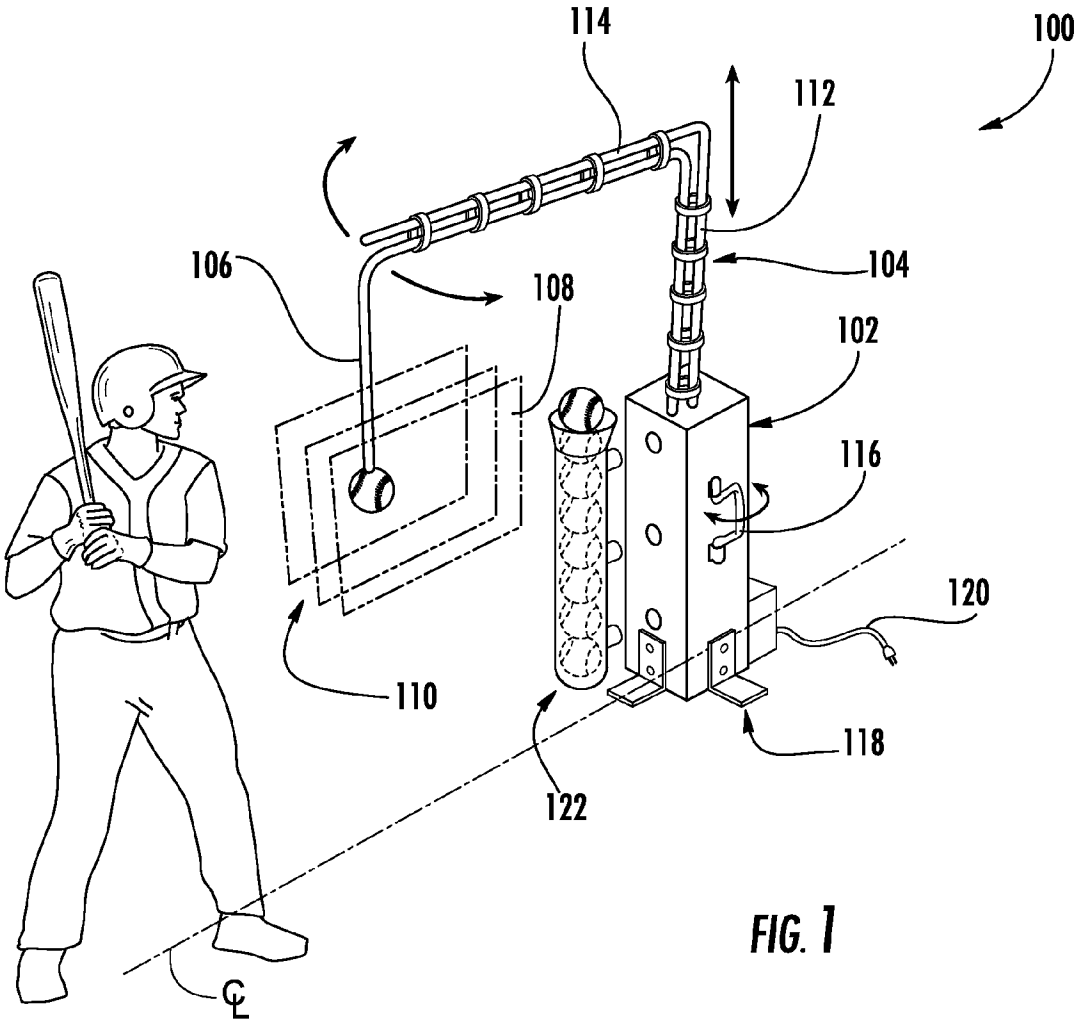
FIG. 1 depicts an exemplary ball hitting training aid configured to move a ball through a three-dimensional strike zone at various and/or random positions.

The present embodiments relate to a hitting training aid that may simulate real game hitting situations. A mechanical tee or stand for batting practice may be provided that presents a ball to a batter at varying and/or random locations, heights, speeds, and/or angles within a three-dimensional strike zone. The mechanical tee may be used with baseballs, tennis balls, softballs, plastic baseballs, training balls, Wiffle® balls, and/or other types of balls.

In one aspect, the mechanical tee may include a vertical stand with a variable position, retractable post that supports flexible tubing. The mechanical tee may have a motor and vacuum pump configuration that provides suction to one end of the flexible tubing. The flexible tubing may have a suction cup at the other end to hold a ball in a suspended manner for striking.

The variable position, retractable post may be controlled by an electronic controller or other processing unit. The electronic controller may control various motors, gears, linkages, and other components to move the variable position, retractable post in a manner that, in turn, moves a suspended ball up-and-down and side-to-side through and within the three-dimensional strike zone. The electronic controller may be programmed to move the retractable post, and thus the suspended ball, through the strike zone at variable and/or random placements. The electronic controller may be programmed to vary the height, location, speed, and/or angle at which the balls are moved into and through the strike zone in either a random or pre-determined manner.

In another aspect, the mechanical tee may have a vertical stand with an attachment for pneumatically tossing or propelling a ball upward for striking. The mechanical tee may automatically feed balls to a batter by forcing the balls out of tubing via air pressure. For instance, the vertical stand may include an air pump and/or compressor configuration that generates a positive pressure. A ball may be mechanically moved into cylindrical tubing, and then pressure may be applied to the ball within the tubing. The tubing may have a curved outlet end, be angled in an upward direction, or otherwise be configured to lift the ball up and into a three-dimensional strike zone. Several balls may be automatically tossed by the mechanical tee without the need to manually replace a ball.

In another embodiment, the mechanical tee may include a portable stand having several telescopic pistons. Each telescopic piston may have a cylindrical body and be configured to lift a ball vertically, such as via air pressure generated by an air pump or compressor. Each telescopic piston may be individually controlled by an electronic controller. The electronic controller may direct the telescopic pistons to each lift a ball to various or differing heights one at a time.

The telescopic pistons may be positioned as a bank of telescopic pistons, such as arranged in a line, a circle, a square, a triangle, or other formation. The electronic controller may randomly select which telescopic piston pitches the next ball, and/or randomly select the height and/or location to which the next telescopic piston pitches the next ball.

In a preferred embodiment, a ball hitting training device may be provided. The ball hitting training device may include a vertical stand; a variable position, retractable post configured to extend upward from the vertical stand; and an electronic controller enclosed within the vertical stand. The electronic controller may be configured to move the retractable post (1) side-to-side horizontally, (2) side-to-side vertically, and/or (3) up and down with respect to the vertical stand. The ball hitting training device may include a vacuum pump enclosed within the vertical stand, with the vacuum pump configured to create a suction force. The ball hitting training device may include a suction line that is vertically and horizontally supported by the retractable post, with the suction line further being attached to the vacuum pump at one end and having a suction cup at the other end. During use, the suction force created by the vacuum pump may vertically support a ball. The electronic controller may direct the retractable post that is supporting the suction line holding the ball vertically to move the ball through a three-dimensional strike zone. The ball may be moved through the three-dimensional strike zone at various heights, locations, speeds, and/or angles (that may be pre-programmed or randomly selected by the electronic controller) during use to mimic game hitting situations and train the hand-eye movement of a batter to hit the ball at varying and/or random locations within the three-dimensional strike zone.

The three-dimensional strike zone may be as defined by the Major League rule book. The three-dimensional strike zone may have a rectangular prism shape. The rectangular prism shape may have length and width dimensions that respectively mirror a length and a width of a rectangular portion of a standard-sized baseball home plate.

For instance, the home plate may be an irregular pentagon. The front side of home plate facing the pitcher may be approximately 17 inches wide, and define the width of the strike zone. The home plate may have parallel sides approximately 8.5 inches long and that connect to the foul lines of the field of play. The home plate may also have approximately 12 inch sides that run down the foul lines, and connect at a point where the two foul lines meet.

After a suspended ball is hit from the mechanical tee during use, the ball may be automatically replaced with a second ball, such as via an automatic ball feeder so that the suction line holds the second ball vertically. The electronic controller may be configured or programmed to then randomly move the second ball through the three-dimensional strike zone at various heights, locations, speeds, and/or angles. The varying heights, locations, speeds, and/or angles may be randomly determined or pre-determined by the electronic controller. The varying heights, locations, speeds, and/or angles at which the first ball is moved through the three-dimensional strike zone may be different from the varying heights, locations, speeds, and/or angles at which the second and subsequent balls are moved through the three-dimensional strike zone.

I. Physiological Training

The present embodiments attempt to address baseball from a neurological perspective and provide physiological training. The present embodiments may strengthen hand-eye coordination so that a batter's swing path may become more flexible to meet a moving baseball rather than being "locked in" on a given swing path—a swing path that may automatically arise with repetitive practice using traditional baseball tee's where the ball is always replaced at the exact same location.

In general, a conventional baseball tee's main objective since its invention has been its utilization as an aid for batters to teach, as well as to continuously work on proper batting swing form. One popular batting tee currently found in baseball is utilized by kids in Little League T-Ball all the way up to professionals in the Major Leagues. The main objective of tee work in baseball is to aid the batter in developing hand-eye coordination so that the ball meets the barrel of the bat ("function") and to follow through the swing with proper hand and arm extension ("form") so that the ball is lifted and the contact that is made gets translated into line drives. Tithe bat meets the top of the ball, chances are the contact will result in grounders. Alternatively, if the bat meets the lower portion of the ball, the contact usually will result in a pop fly. Every batter in baseball wants to avoid ground outs and fly outs. It is the combination of good form and function that creates great batters in baseball.

A second objective in utilizing a tee is to teach and continue to develop hand-eye coordination, which may be referred to herein as "function." Even when the barrel of the bat meets the center of the ball ("function"), the batter requires proper hand and arm extension ("form") to translate good contact into hits.

Like all spoils, the main school of thought in baseball with respect to becoming better batters is through repetitive practice. While that may be true, it is believed that repetition with respect to tee work may be a double-edged sword. The standard baseball tee which is used today, while accomplishing its objective with respect to form, may be a limited aid and works against batters with respect to function. The development of the mechanical tee of the present embodiments should now bridge the gap between form and function thereby creating better batters and increasing the level of performance in baseball at all levels.

The most common, widely used baseball tee is a tube constructed of durable plastic upon which the baseball rests on top of the tube. The tube can be adjusted up or down to lie within a particular strike zone based upon the batter's height. The strike zone as it is defined in the Major League rule book and which plate umpires theoretically should adhere to will move up or down depending upon the batter's height.

When a batter utilizes a tee, a baseball is placed on top of the tee and the batter swings. However, batters may be continuously hitting baseballs at the same height. Continuous repetition in this manner causes a particular pathway in the brain to be utilized over and over again thereby creating muscle movement to lock in the batter's swing at a baseball at one particular location and/or height on top of the tee. It is believed that repetitive muscle movements create memory of their own, sometimes referred to as "muscle memory" and thereby may act independently of hand-eye coordination. In real baseball game situations, the likelihood of pitches coming in at the same height as the baseball on top of the tee is very low. Therefore, when a batter's hand-eye coordination needs to be flexible to meet the ball with the barrel of the bat, that repetitive tee work may sometimes kick in and the swing may automatically lock the batter's arm muscle movement to a path that it has made hundreds of times, i.e., at the height of a baseball on top of the tee, thereby creating a swing and miss, and hence the strike.

The differing mechanical tee designs of the present embodiments may prevent the hitting of a baseball successively at the same spot. The mechanical tee designs may include an electronic controller that may be programmed so that the mechanical arms, mechanical telescopic pistons, and/or air propelled systems place the ball randomly at thousands of different points within a strike zone.

The present embodiments may train hand-eye movement by causing a batter to swing at a ball at differing locations, which may be the best batting aid to effectively mimic game situations the closest. Additionally, while the swing would be repetitive to insure that balls are being hit in a line drive manner ("form"), that repetition may not cause muscle memory to lock the arm movement into any one particular location ("function"), thereby reducing strike outs that are caused in this manner. The present mechanical tee embodiments may also be accompanied by a ball feeder such that the batter may continuously train without having to replace a baseball after each swing.

II. Exemplary Mechanical Tee for Three-Dimensional Ball Movement

The present embodiments relate to batting aids that allow a baseball to be hit at different locations. FIG. 1 depicts an exemplary ball hitting training aid 100 configured to move a ball through a three-dimensional strike zone at various and/or random positions. The ball hitting training aid 100 may include a vertical stand 102, a retractable post 104, a flexible tubing 106, and a suction cup 108. The ball hitting training aid 100 may include additional, fewer, or alternative components.

As shown in FIG. 1, the training aid 100 may include a vertical stand 102 with a retractable post 104. The retractable post 104 may be configured to move through either two or three dimensions. For instance, the retractable post 104 may be configured to move side-to-side horizontally and/or side-to-side vertically with respect to a three-dimensional strike zone 110, and/or up-and-down with respect to the vertical stand 102. The movement of the retractable post 104 may be controlled or directed by an electronic controller associated with the vertical stand 102.

The retractable post 104 may support a flexible tubing 106 with a suction cup 108 located on one end. Within the vertical stand 102 there may be a motor and vacuum pump configured to create a suction or vacuum pressure. The vacuum pressure may be applied to the other end of the flexible tubing 106 to create suction at the end with the suction cup 108.

The suction cup 108 may be sized to fit with a ball. The flexible tubing 102 may allow a suction force to be delivered to the suction cup 108 to allow the ball to be held vertically within a three-dimensional strike zone. During use, a hitter may swing at the ball supported vertically by the suction cup 108, and the ball may be moved up/down and side-to-side by movement of the retractable post 104.

A vertical arm 112 of the retractable post 104 may extend vertically upward from vertical stand 102. The vertical arm 112 may generally extend in the vertical or up-and-down direction. The vertical arm 112 may run into a horizontal arm 114 of the retractable post 104, such as via a 90 degree turn. The horizontal arm 114 may extend generally horizontally away from the plane of the vertical arm 112 and vertical stand 102 to create space for the three-dimensional strike zone and the batter's swing.

The flexible tubing 106 may be attached to the vertical arm 112 and the horizontal arm 114 such as by tie wraps or other fasteners. The flexible tubing 106 may hang down vertically from the end of the horizontal arm 114 and/or the retractable post 104. The flexible tubing 106 may allow a ball suspended via the suction cup 108 to hang down into the three-dimensional strike zone in a loose fashion to allow flexibility with respect to the movement of the ball.

The electronic controller may include a processor with a programmable memory. The processor and/or memory may include instructions to direct the movement of the retractable post 104, and thus a suspended ball. The electronic controller may include electronics and wiring that allow the electronic controller to operate motors, gears, linkages, and/or other mechanical components that move all or portions of the retractable post 104, such as the vertical arm 112 and the horizontal arm 114. The mechanical components controlled by the electronic controller that move the retractable post 104 may be enclosed within the vertical stand 102 and/or attached to the retractable post 104.

The electronic controller may move the retractable post 104 vertically. For example, the electronic controller may direct the movement of the vertical arm 112 up-and-down or in-and-out of the vertical stand 102. As a result, during use, the ball may be moved vertically within the strike zone.

The electronic controller may also rotate the retractable post 104. The electronic controller may direct the movement of the horizontal arm 114 side-to-side or round-and-round. The horizontal arm 114 may be moved in a complete circle, or 360 degrees, around the vertical stand 102. Additionally or alternatively, the horizontal arm 114 may be moved back and forth over a range of movement—similar to the window wiper of a car. For instance, the horizontal arm 114 may be moved back and forth over 90 degrees or other range with respect to the batter when viewed from above. As a result, during use, the ball may be moved horizontally within the strike zone.

The horizontal arm 114 may have an expandable length. The horizontal arm 114 may extend and retract to move the ball within the strike zone either closer to or farther from the batter. The electronic controller may direct various motors, gears, linkages, springs, or other components within the retractable post 104 that control the length of the horizontal arm 114. The electronic controller may extend or retract the length of the horizontal arm 114 while the ball is being moved within the strike zone to provide additional movement to the ball. The electronic controller may vary the speed at which the length of the horizontal arm 114 is changed while moving the ball through the strike zone.

As noted, the electronic controller may be programmed to move the retractable post 104, and thus the ball hanging via the suction cup 108, side-by-side and/or up-and-down through the three-dimensional strike zone. The electronic controller may move the retractable post 104 at various speeds at each height and location. The swinging movement of the retractable post 104 and the flexibility of the flexible tubing 106 may provide freedom of movement of the suspended ball during use.

For instance, increasing the speed at which the ball is being swung side-to-side may cause the end of the flexible tubing 106 with the suction cup 108 and the ball to move horizontally away from the vertical stand 102 (and toward the batter, but within the strike zone) and vertically upward within the strike zone due to centrifugal forces acting on the ball. Decreasing the speed at which the ball is being swung side-to-side may cause the end of the flexible tubing 106 with the suction cup 108 and the ball to move horizontally toward the vertical stand (and away from the batter, but within the strike zone) and vertically downward within the strike zone due to gravity acting on the ball.

By controlling the side-to-side speed and/or movement of the horizontal arm 114 and the up-and-down speed, movement, and/or height of the vertical arm 112, the electronic controller may control the ball's movement through the strike zone at various heights, locations, speeds, and/or angles. The electronic controller may also move the horizontal arm 114 and/or the vertical arm 112 in a random fashion. The speed and direction of the horizontal arm 114 may be varied. The horizontal arm 114 may be swung back and forth through the strike zone, or rotated 360 degrees around the vertical stand 102. Simultaneously, the vertical arm 112 may be moved up or down while the ball is moving through the strike zone.

The electronic controller changing the direction and speed of the ball may simulate game hitting conditions, such as fastballs, curve balls, sliders, change ups, and other types of pitches. The electronic controller may randomly attempt to simulate various types of pitches, such as following a fast ball with a change up or off speed pitch, followed by another fast ball, and then a simulated curve ball.

The vertical stand 102 may have a carry handle 116 and/or one or more support brackets 118. Each side of the vertical stand 102 may include a dedicated support bracket 118. The support brackets 118 may swing down during use to vertically support the vertical stand 102 in an upright position. The support brackets 118 may swing up and rest against the body of the vertical stand 102 to facilitate storage during non-use. The vertical stand 102 may include a 120V outlet 120 with a standard electrical plug to power various components, such as the electronic controller, the motor and vacuum pump, an air pump or compressor, and other components.

The vertical stand 102 may be between approximately two and five feet in height. The retractable post 104 may have a variable length vertical arm 112 of between approximately two and ten feet in height. The retractable post 104 may have a variable length horizontal arm 112 of between approximately two and ten feet in length. Components having other dimensions may be used.

The present embodiments also may include an automatic ball feeder. As shown in FIG. 1, the training aid 100 may include a ball feeder 122. The ball feeder 122 may be attached to the vertical stand 102. The ball feeder 122 may store one or more balls, such as in cylindrical tubing. The ball feeder 122 may move the next ball into a ball loading position at which the suction cup 108 can reach the ball.

After a current ball is hit, the suction cup 108 may be left exposed and provide a suction force to the environment. At which point, the electronic controller of the vertical stand 102 may be configured to automatically move a next ball into the vicinity of the suction cup 108, or the suction cup 108 into the vicinity of the next ball, such that the suction forces lift the next ball. The electronic controller of the vertical stand 102 may then move the next ball through the strike zone by directing the movement of the retractable post 104 as discussed herein.

During use, the electronic controller may sense that the suction force in the flexible tubing has changed due to the current ball being hit and the end of the flexible tubing being exposed to the environment and suctioning air. Or the electronic controller may sense that the weight on the end of the retractable post 104 has lessened or changed. Other means of sensing that the ball needs to be replaced may be used.

Once the electronic controller determines that the current ball has been hit, the controller may move or bend the end of the horizontal arm 114 nearest the suction cup 108 downward toward the base of the vertical stand 102 and over the top of the ball feeder 122. At the same time, the vertically arm 112 may also be re-positioned, such as moved into a fully extended position. Alternatively, an expandable length horizontal arm 114 may be retracted to move the suction cup 108 horizontally inward toward the vertical stand and over the top of the ball feeder 122. As a result, the suction cup 108 may be automatically moved toward the base of the vertical stand 102 and into a ball loading position where it can reach the next ball.

The ball feeder 122 may be positioned to provide the next ball in a location where the suction forces exerted by the suction cup 108 may lift the next ball such that the next ball is suspended by the suction cup 108. Then the horizontal arm 114 may be lifted, swung, or extended back out to a horizontal position in which the next ball is suspended within the strike zone. The electronic controller may then again start moving the horizontal arm 114 and/or vertical arm 112 to move the next ball through the strike zone at varying and/or random heights, locations, speeds, and/or angles.

III. Exemplary Mechanical Tee for Vertically Lifting Balls

In another aspect, a vertical stand may include an optional tubular feeder/thrower configured as a vertical throw attachment to the vertical stand. The tubular ball feeder/thrower may be in communication with a pneumatic line. The tubular ball feeder/thrower may have a circular inlet for accepting a baseball or other ball. Once the ball is fed to the tubular ball feeder/thrower, the air pressure may force the ball down the tube to an outlet. The outlet may direct the ball in a generally vertical direction and up into an imaginary strike zone. The hitter may take a swing at the ball that is lifted vertically via the air controlled lift action.

The vertical stand may be attached to, or even enclose, a control module. The control module may include an electronic controller, a motor, vacuum pump, air pump or compressor, and/or other components. The control module may have an external power cord. The vertical stand may be attached to the ball feeder/thrower. The ball feeder may include a cylindrical portion internally sized to permit the passage of a ball. At one end of the ball feeder, a pneumatic line or tube attachment may be provide positive air pressure from the control module/vertical stand.

At the other end of the ball feeder, the cylindrical end may have an opening to feed the pitch to the batter. Air pressure may force a ball through the ball feeder to a randomly selected location within a three-dimensional strike zone.

Figure 2:
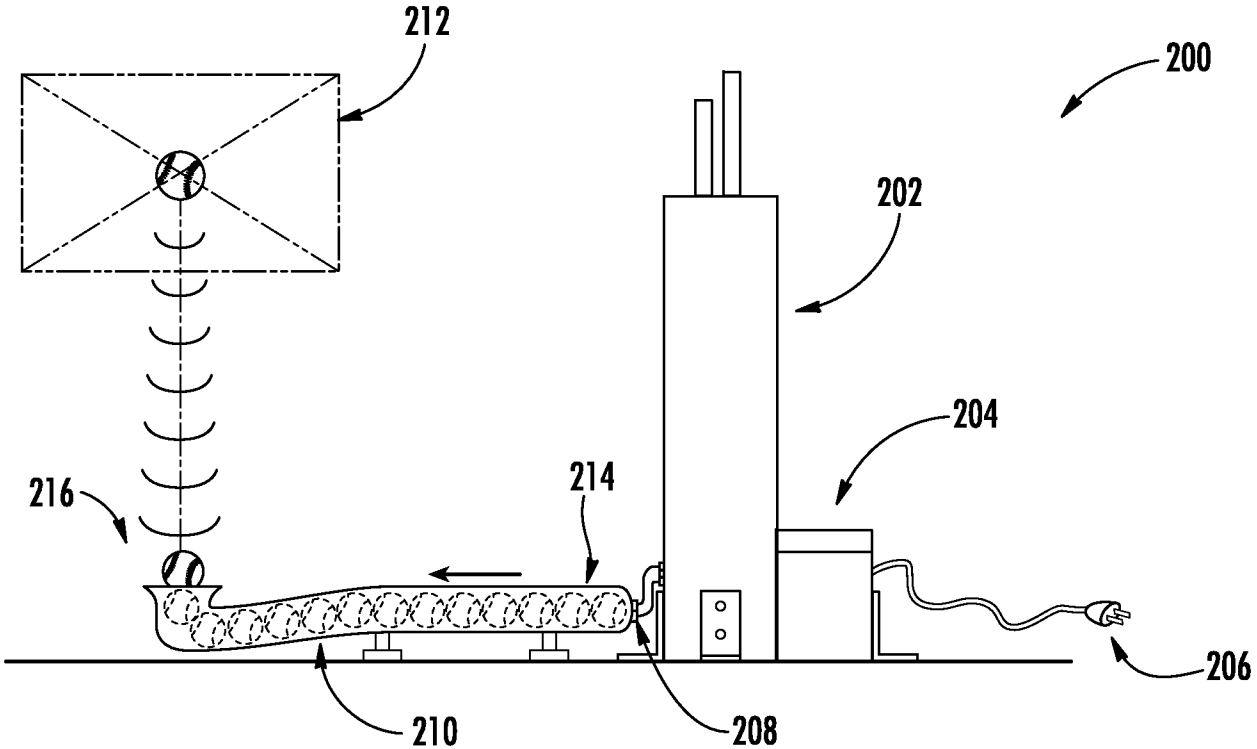
FIG. 2 depicts an exemplary ball hitting training aid configured to lift balls to various and/or random positions within a three-dimensional strike zone.

FIG. 2 depicts an exemplary ball hitting training aid 200 configured to lift balls to various and/or random positions within a three-dimensional strike zone. The ball hitting training aid 200 may include a vertical stand 202, a control module 204, a power outlet 206, a pneumatic line 208, and a ball feeder 210. The ball hitting training aid 200 may include additional, fewer, or alternative components.

The vertical stand 202 may include similar, additional, less, or alternative functionality as the vertical stand of FIG. 1 described above. The vertical stand 202 may be attached to a control module 204. The control module 204 may include a motor, vacuum pump, air pump or compressor, and/or an electronic controller. The motor and vacuum pump may provide suction force. The air pump or compressor configuration may provide positive pressure. The control module 204 may be powered by external power via a 120V power outlet 206. Alternatively, the control module 204 may be powered internally, such as by a battery.

The ball feeder 210 may have a cylindrical shape. The ball feeder 210 may be sized to have clearance or interference fits with the balls being pitched. In one embodiment, the ball feeder 210 is dimensioned for use with standard sized baseballs. Other types of balls may be used, such as those mentioned elsewhere herein.

During use, the pneumatic line 208 provides positive pressure generated by the air pump or compressor in the control module 204 to the cylindrical tubing of the ball feeder 210. After a ball is fed into the ball feeder/thrower 210, such as via an inlet 214, the positive pressure forces the ball through the length of the ball feeder 210 and out an outlet 216 at the other end of the ball feeder 210. The outlet 216 may be shaped or curved to force the ball upward and into a three-dimensional strike zone 212. Alternatively, the outlet 216 may be angled in an upward direction to direct the ball into the strike zone 212.

The electronic controller may control the positioning of the ball within the strike zone 212. The electronic controller may vary the air pressure being sent to the ball feeder 210 and applied to the next pitch. The electronic controller may also vary the pressure being applied to individual pitches/balls in either a random or preprogrammed manner. Randomly changing the height of the next pitch within the strike zone 212 by randomly changing the positive pressure being applied to the ball feeder 210 may facilitate simulating game hitting conditions.

IV. Exemplary Mechanical Tee Having Several Telescopic Pistons

In another embodiment, a vertical stand may include several telescopic pistons. Each of the pistons may be configured to lift, via air pressure, a ball, such as a baseball or other ball, vertically and/or at an angle into a strike zone. Each of the pistons may be set to raise their respective ball to a different height and/or locations, such that the batter does not know the location of the ball before the pitch.

The electronic controller may randomly select which one of the several pistons throws next. The electronic controller may also randomly select the air pressure and/or the height, direction, and/or speed at which the next piston throws. The order of the pistons throwing, and the location to which each piston throws, may be varied randomly or pre-determined. For instance, the vertical stand may include one or more control buttons that allow a user to select whether the balls are pitched sequentially (if the pistons are aligned in a row) or randomly, and/or whether the height and/or location of the balls pitched is constant, varied, or random. A number of user-selectable pitching routines detailing a sequence of different pitches may be programmed and saved on a memory unit.

Figure 3:
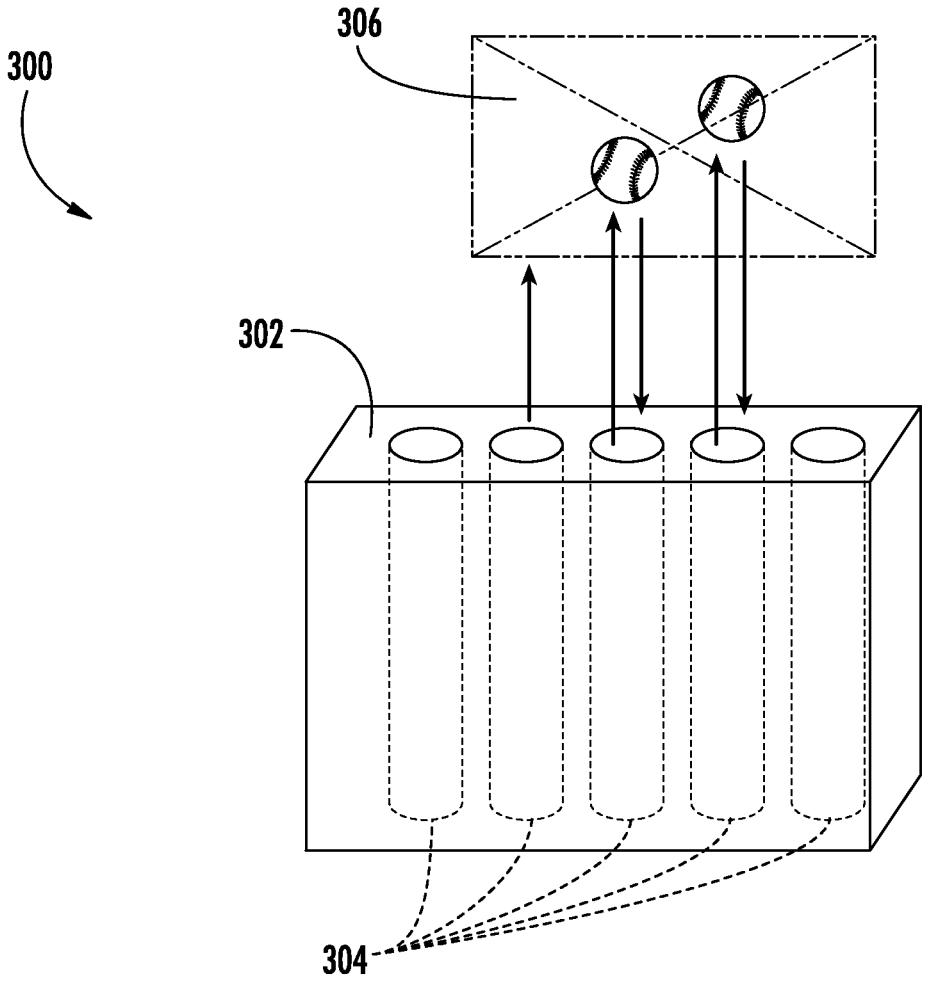
FIG. 3 depicts an exemplary ball hitting training aid having several telescopic pistons configured to lift balls up to various and/or random positions.

FIG. 3 depicts an exemplary ball hitting training aid 300 having several telescopic pistons configured to lift balls up to varying and/or randomly selected heights. The ball hitting training aid 300 may have a vertical stand 302 and several telescopic pistons 304. The ball hitting training aid 300 may have additional, fewer, or alternate components.

The vertical stand 302 may enclose several pistons 304 in various formations to form a bank of pistons. FIG. 3 depicts several pistons 304 aligned in a row. Alternatively, the pistons may be organized as a square, circle, triangle, or other shape.

The vertical stand 302 may enclose a control module, such as the control modules discussed above with respect to FIGS. 1 and 2. The control module may include a programmable electronic controller, a motor, vacuum pump, air pump or compressor, and/or other components. The electronic controller may be configured to vary the height and/or angle at which each ball is pitched into the three-dimensional strike zone 306. The electronic controller may randomly determine from which one of the several pistons 304 that the next ball is tossed from, and randomly determine at what height and/or angle the next ball is tossed.

The electronic controller may vary the height to which each ball is pitched by varying an amount of air pressure applied to each piston 304 after the piston 304 is loaded with a ball. The air pressure may be generated by an air pump or compressor configuration enclosed within the vertical stand 302. Additionally, each piston 304 may include cylindrical tubing. The cylindrical tubing may be repositionable by the electronic controller to alter the angle and location to which the ball is pitched.

The electronic controller may randomly vary pitch parameters, such as ball identification, ball height, ball angle, and/or ball speed. Alternatively, the electronic controller may have preprogrammed pitching routines saved in a memory. The pitching routines may be automatically selected by the electronic controller or be user-selectable.

V. Exemplary Method of Use

Figure 4:
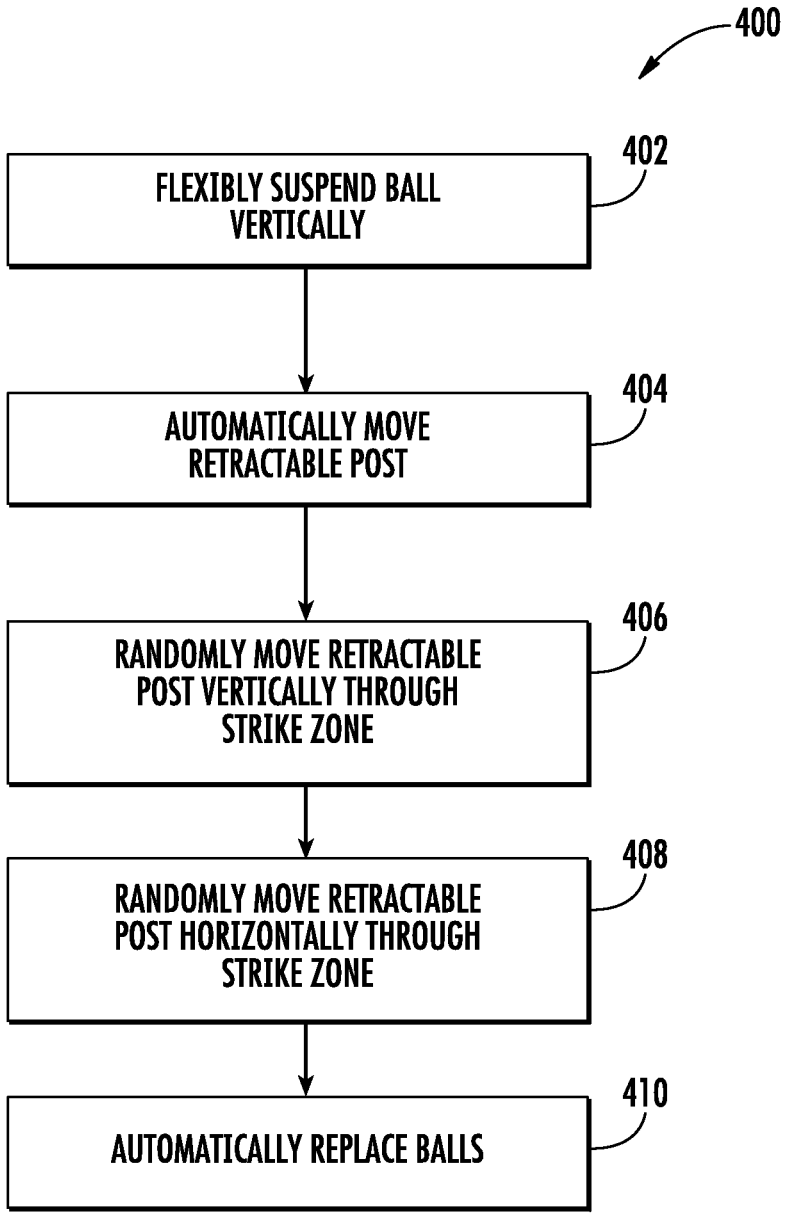
FIG. 4 depicts an exemplary method of simulating game hitting conditions via a ball hitting training aid.

FIG. 4 depicts an exemplary method of simulating game hitting conditions via a ball hitting training aid 400. The method 400 may include flexibly suspending a ball via retractable post 402, automatically moving the retractable post 404, randomly moving the retractable post vertically 406, randomly moving the retractable post horizontally 408, and automatically replacing the ball after a hit 410. The method may include additional, fewer, or alternate steps.

The method 400 may include flexibly suspending a ball via a retractable post 402. The retractable post may provide a suction force to the ball, such as via flexible tubing. The flexible tubing may suspend or dangle down from a frame portion of the retractable post a sufficient length such that flexible movement is provided to the ball during use. For instance, the flexible tubing may extend between approximately 12 and 60 inches below a horizontal arm portion of the retractable post.

The method 400 may include automatically moving the retractable post 404. For instance, the retractable post may be directed by an electronic controller. The electronic controller may control various motors, gears, linkages, springs, latches, arms, and other components to direct the movement of the retractable post. The electronic controller may move the retractable post in such a manner that the ball is flexibly suspended at the end of the flexible tubing, such as via a suction cup, and may be moved through a three-dimensional strike zone at various heights, locations, speeds, and/or angles. The electronic controller may move the retractable post side-to-side horizontally, up-and-down vertically, and inward-and-outward horizontally with respect to a vertical stand and within the strike zone. As a result, a suspended ball may be moved in any direction within the strike zone.

The method 400 may include randomly moving the retractable post vertically 406. The electronic controller may direct the movement of mechanical components to control the height of the retractable post. For example, the electronic controller may direct a motor or other components that raise and lower a vertical arm portion of the retractable post. The electronic controller may raise and/or lower the vertical portion of the retractable post at the same time that the electronic controller is directing the movement of the ball through the strike zone horizontally. As a result, rising, falling, and/or angled pitches may be simulated and presented to the batter.

The method 400 may include randomly moving the retractable post horizontally 408. The electronic controller may direct the movement of mechanical components to control the horizontal positioning of the retractable post. For example, the electronic controller may direct a motor or other components that move a horizontal arm portion of the retractable post forward and backwards, or round and round, with respect to a batter and the vertical stand. The electronic controller may also be configured to extend and retract an expandable horizontal arm to move the ball within the strike zone either closer to or farther from the batter.

The electronic controller may move the horizontal arm portion of the retractable post horizontally at the same time that the electronic controller is directing the movement of the ball through the strike zone vertically. The electronic controller may adjust the speed of the horizontal arm movement as a means of controlling the speed at which the ball moves through the strike zone horizontally.

The electronic controller may move the retractable post, and thus the ball, both vertically and horizontal through and within the strike zone to simulate various pitches. The electronic controller may move the ball horizontally and move the ball vertically at the same or different speeds. For instance, the speed at which the electronic controller moves the ball vertically within the strike zone may be slower than the speed at which the electronic controller moves the ball horizontally within the strike zone, or vice versa.

The method 400 may include automatically replacing a ball 410. After the current ball is hit, the electronic controller may sense that the ball needs to be replaced. The electronic controller may move the retractable post to a location in which the suction force at the end of the flexible tubing may lift the next ball from a ball feeder. The suction force may suspend the next ball from the end of the flexible tubing. After which, the electronic controller may move the next ball within the strike zone at varying and/or randomly determined heights, locations, speeds, and/or angles. The method may also involve the use of a net to catch the balls that have been batted.

The electronic controller may provide the functionality as discussed herein. The electronic controller may be implemented as a microprocessor, microcontroller, application specific integrated circuit (ASIC), discrete logic, or a combination of other types of circuits acting as explained herein. The electronic controller may include a central processing unit (CPU), a memory, a storage device, a data input device, and a display. The electronic controller is provided for descriptive purposes and is not intended to limit the scope of the present system. The electronic controller may have additional, fewer, or alternate components.

A program may reside on the memory, storage device, or another memory (e.g., hard drive removable media, RAM). The program may include one or more sequences of executable code or coded instructions that are executed by the CPU. The program may be loaded into the memory from the storage device or a network or removable media. The CPU may execute one or more sequences of instructions of the program. The program may provide functionality as discussed herein. As one of ordinary skill in the art would recognize, the program may be written in various programming languages, such as C, C++, Turbo C++, Java, object oriented languages, or other languages.

The present invention may be embodied in other forms without departing from the spirit or essential attributes thereof and, accordingly, reference should be had to the following claims rather than the foregoing specification as indicating the scope of the invention. Further, the illustrations of arrangements described herein are intended to provide a general understanding of the structure of various embodiments, and they are not intended to serve as a complete description of all the elements and features of apparatus and systems that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims.

The invention claimed is:

1. A ball hitting training device comprising:

a vertical stand;

a retractable post configured to extend upward from the vertical stand;

an electronic controller enclosed within the vertical stand, the electronic controller being configured to move the retractable post (1) side-to-side horizontally, (2) inward-and-outward horizontally, and (3) up and down with respect to the vertical stand;

a vacuum pump enclosed within the vertical stand, the vacuum pump configured to create a suction force; and a suction line that is vertically and horizontally supported by the retractable post, the suction line further being attached to the vacuum pump at one end and having a suction cup at the other end such that during use the suction force created by the vacuum pump can vertically support a ball;

wherein the electronic controller directs the retractable post that is supporting the suction line holding the ball vertically to move the ball through a three-dimensional strike zone at various heights during use to mimic game situations and train the hand-eye movement of a batter to hit the ball at varying random locations within the three dimensional strike zone as defined by the Major League rule book.

2. The ball hitting training device of claim 1, wherein the ball is a baseball.

3. The ball hitting training device of claim 1, wherein the three-dimensional strike zone has a rectangular prism shape, the rectangular prism shape having length and width dimensions that respectively mirror a length and a width of a rectangular portion of a standard-sized home plate.

4. The ball hitting training device of claim 1, wherein after the ball is hit, the ball is replaced with a second ball via an automatic ball feeder such that the suction line holds the second ball vertically and the electronic controller is configured to then randomly move the second ball through the three-dimensional strike zone at various heights.

5. The ball hitting training device of claim 1, wherein the ball is a tennis ball.

6. The ball hitting training device of claim 1, wherein the vertical stand further encloses a compressor configured to provide a positive pressure to a pneumatic lifting device.

7. The ball hitting training device of claim 1, wherein the electronic; controller moves the ball through the three-dimensional strike zone in a manner that simulates more than one type of pitch.

8. A ball hitting training device comprising:

a vertical stand;

a retractable post configured to extend upward from the vertical stand;

an electronic controller enclosed within the vertical stand, the electronic controller being configured to move the retractable post (1) side-to-side horizontally, and (2) inward-and-outward horizontally;

a vacuum pump enclosed within the vertical stand, the vacuum pump configured to create a suction force; and a suction line that is vertically and horizontally supported by the retractable post, the suction line further being attached to the vacuum pump at one end and having a suction cup at the other end such that during use the suction force created by the vacuum pump can vertically support a ball;

wherein the electronic controller directs the retractable post that is supporting the suction line holding the ball vertically to move the ball through a three-dimensional strike zone at various heights during use to mimic game situations and train the hand-eye movement of a batter to hit the ball at varying and random locations within the three-dimensional strike zone.

9. The ball hitting training device of claim 8, wherein the three-dimensional strike zone is defined by the Major League rule book.

10. The ball hitting training device of claim 8, wherein the three-dimensional strike zone is a rectangular prism whose length and width dimensions mirror a length and a width of a rectangular portion of a standard baseball home plate.

11. The ball hitting training device of claim 8, wherein the ball is a baseball.

12. The ball hitting training device of claim 8, wherein after the ball is hit, the ball is replaced with a second ball via an automatic ball feeder such that the suction line holds the second ball vertically and the electronic controller is configured to then randomly move the second ball through the three-dimensional strike zone at various heights.

13. The ball hitting training device of claim 8, wherein the vertical stand further encloses a compressor configured to provide a positive pressure to a pneumatic lifting device.

14. The ball hitting training device of claim 8, wherein the electronic controller is configured to randomly move the ball through the three-dimensional strike zone at various heights, speeds, and angles.

15. A ball hitting training device comprising:

a vertical stand;

a retractable post configured to extend upward from the vertical stand;

an electronic controller enclosed within the vertical stand, the electronic controller being configured to move the retractable post (1) side-to-side horizontally, and (2) up and down with respect to the vertical stand;

a vacuum pump enclosed within the vertical stand, the vacuum pump configured to create a suction force; and a suction line that is vertically and horizontally supported by the retractable post, the suction line further being attached to the vacuum pump at one end and having a suction cup at the other end such that during use the suction force created by the vacuum pump can vertically support a ball;

wherein the electronic controller directs the retractable post that is supporting the suction line holding the ball vertically to move the ball through a three-dimensional strike zone at various heights during use to mimic game situations and train the hand-eye movement of a batter to hit the ball at varying and random locations.

16. The ball hitting training device of claim 15, wherein the three-dimensional strike zone is defined by the Major League rule book.

17. The ball hitting training device of claim 15, wherein the three-dimensional strike zone is a rectangular prism whose length and width dimensions mirror a length and a width of a rectangular portion of a standard baseball home plate.

18. The ball hitting training device of claim 15, wherein the ball is a baseball.

19. The ball hitting training device of claim 15, wherein after the ball is hit, the ball is replaced with a second ball via an automatic ball feeder such that the suction line holds the second ball vertically and the electronic controller is configured to then randomly move the second ball through the three-dimensional strike zone at various heights.

20. The ball hitting training device of claim 15, wherein electronic controller is configured to move the ball through the three-dimensional strike zone at random heights and speeds.

* * * * *